US005727967A

United States Patent [19]

Chen

[11] Patent Number: 5,727,967

[45] Date of Patent: Mar. 17, 1998

[54] METAL CONTACT PLATE OF A MODULE PLUG

[76] Inventor: Hsin-Huei Chen, No. 48, Sec. 2, Chang An Rd., Lu Chu Hsiang, Tao Yuan Hsien, Taiwan

[21] Appl. No.: 734,916

[22] Filed: Oct. 22, 1996

[51] Int. Cl.[6] ..... H01R 4/24

[52] U.S. Cl. ..... 439/418; 439/425

[58] Field of Search ..... 439/418, 425, 439/426, 395, 404

[56] References Cited

U.S. PATENT DOCUMENTS

| | | | |
|---|---|---|---|
| 3,761,869 | 9/1973 | Hardesty et al. | 439/418 |
| 4,607,905 | 8/1986 | Vaden | 439/418 |
| 4,650,269 | 3/1987 | Denkmann et al. | 439/418 |

FOREIGN PATENT DOCUMENTS

| | | | |
|---|---|---|---|
| 2455354 | 5/1975 | Germany | 439/418 |
| 2542219 | 3/1977 | Germany | 439/418 |

*Primary Examiner*—J. J. Swann

*Attorney, Agent, or Firm*—Varndell Legal Group

[57] ABSTRACT

A metal contact plate for a module plug, having two lateral contact legs and an intermediate contact leg adapted for cutting in the insulator of an electrical wire to contact the conductor from two opposite sides at three contact points, the lateral contact legs having a respective transversely disposed back groove at the top and the intermediate contact leg having a transversely disposed front groove at the top, the grooves of the contact legs permitting the contact legs to expanded outwards and clamped on the conductor of the electrical wire when stamped.

1 Claim, 9 Drawing Sheets

METAL CONTACT PLATE OF A MODULE PLUG

BACKGROUND AND SUMMARY OF THE INVENTION

The present invention relates to module plugs, and relates more specifically to a metal contact plate for module plugs which can be firmly installed in a channel in a module plug housing and positively connected to the corresponding electrical wire.

A module plug for telephone lines or the like as shown in FIG. 1, comprises a plurality of parallel channels, a plurality of electrical wires respectively inserted into the channels, and a plurality of metal contact plates respectively connected to the electrical wires in the channels and fixed in place by stamping. FIGS. 2 and 3 show a metal contact plate for this purpose. This metal contact plate comprises two downwardly disposed lateral contact legs, and a downwardly disposed intermediate contact leg spaced between the lateral contact legs. This structure of metal contact plate has drawbacks. When installed, a part of the insulator tends to be jammed in the contact legs at the top (see FIG. 4), and the spring power of the contact legs tends to force the contact legs upwards certain length of time (normally about 7 days) after installation, thereby causing the contact less unable to contact the conductor of the single-core electrical wire positively (see FIG. 5). When the metal contact plate is forced upwards by the spring power of the contact legs, the inside wall of the corresponding channel of the module plug housing tends to be damaged by the metal contact plate, thereby causing a voltage interference to occur. The aforesaid displacement of the metal contact plate which occurs several days after its installation, affects the conductivity and, may cause the metal contact plate to be forced out of place during the packing procedure of the module plug or its delivery. Furthermore, the narrow gaps between the intermediate contact leg and the lateral contact legs are not sufficient to enable the contact legs to be outwardly expanded and closely attached to the periphery of the conductor of the single-core electrical wire (see FIG. 6), and a contact error tends to occur.

The present invention has been accomplished to provide a metal contact plate for module plugs which eliminates the aforesaid drawbacks. According to one aspect of the present invention, the metal contact plate comprises two lateral contact legs and an intermediate contact leg respectively and downwardly extended from a neck thereof and adapted for cutting in the insulator of an electrical wire to contact the conductor from two opposite sides at three contact points, the lateral contact legs having a respective transversely disposed back groove at the top and the intermediate contact leg having a transversely disposed front groove at the top, the grooves of the contact legs eliminating upward reactive force and permitting the contact legs to be positively deformed and clamped 30 on the conductor of the electrical wire when stamped. Because the grooves of the contact legs eliminate upward reactive force during the stamping process, the metal contact plate does not damage the inside wall of the corresponding channel of the module plug housing. According to another aspect of the present invention, the gaps which are defined between the intermediate contact leg and the lateral contact legs have a respective width made gradually wider from the neck towards the bottom side of the metal contact plate so that the contact legs can be outwardly expanded and closely attached to the periphery of the conductor of the electrical wire.

DETAILED DESCRIPTION OF THE PREFERRED EMBODIMENT

Figure 9:
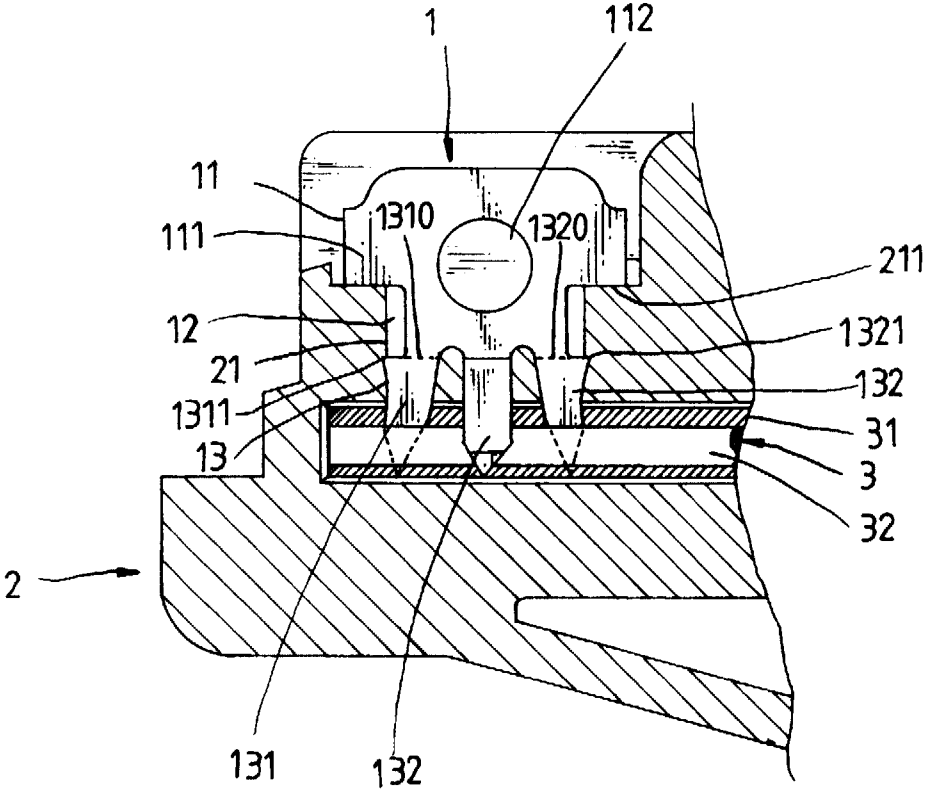
FIG. 9 is a sectional view showing the metal contact plate installed in a channel in a module plug housing and connected to a single-core electrical wire.

Referring to FIGS. from 7 to 11, a metal contact plate 1 is mounted in one channel 21 in a module plug housing 2 (see FIG. 9). The metal contact plate 1 comprises a positioning section 11, a contact section 13, and a neck 12 connected between the positioning section 11 and the contact section 13. The positioning section 11 comprises two stop edges 111 bilaterally and perpendicularly extended from the neck 12 in reversed directions and adapted for stopping at two horizontal support faces 211 of the channel 21, and a locating hole 112 in the middle for positioning during the stamping process. The neck 12 downwardly extends from the locating hole 112, having a width smaller than that of the positioning section 11. The contact section 13 extends downwards from the neck 12, comprising three contact legs, namely, the first contact leg 131, the second contact leg 132, and the third contact leg 133 respectively downwardly extended from the neck 12. The first contact leg 131 and the second contact leg 132 ace symmetrically disposed at two opposite lateral sides. The third contact leg 133 is spaced between the first contact leg 131 and the second contact leg 132. The first contact leg 131 and the second contact leg 132 and the third contact leg 133 have a respective bevel bottom edge 1312, 1322, or 1332 adapted for cutting into the insulator 31 of an electrical wire 3 and making contact with the conductor 32 thereof. The bevel bottom edge 1332 of the third contact leg 133 and the bevel bottom edges 1312, 1322 of the first contact leg 131 and second contact leg 132 respectively disposed at two reversed sides, that is the bevel bottom edges 1312 and 1322 are disposed at the front side of the metal contact plate 1 and the bevel bottom edge 1332 is disposed at the back side of the metal contact plate 1. The first contact leg 131 and the second contact leg 132 have a respective shoulder 1311 or 1321 respectively disposed at the top and horizontally spaced from the neck 12. The shoulders 1311, 1321 of the first contact leg 131 and second contact leg 132 are forced into engagement with two opposite vertical side wall of the channel 21 of the module plug housing 2.

Figure 1:
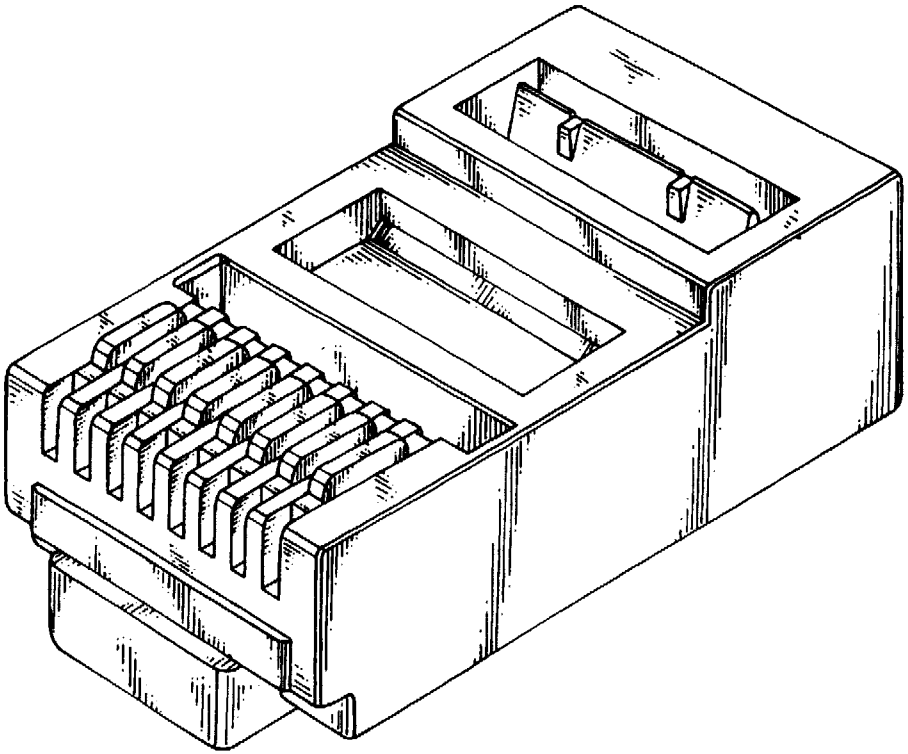
Fig. 1 PRIOR ART
FIG. 1 is an elevational view of a regular module plug.
Figure 2:
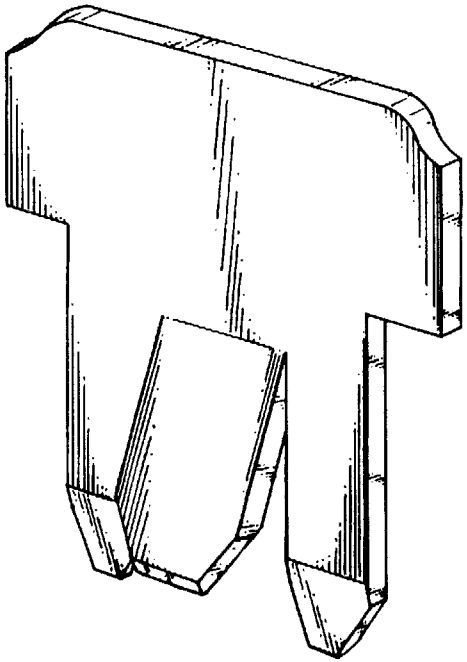
Fig. 2 PRIOR ART
FIG. 2 is an elevational view enlarged scale of a metal contact plate for module plugs according to the prior art.
Figure 4:
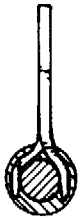
Fig. 4 PRIOR ART
FIG. 4 is a sectional view showing the metal contact plate fastened to the single-core electrical wire, and a part of the insulator jammed in the contact legs according to the prior art.
Figure 3:
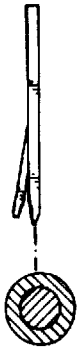
Fig. 3 PRIOR ART
FIG. 3 is a sectional view of the prior art metal contact plate and a single-core electrical wire.
Figure 6:
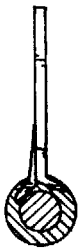
Fig. 6 PRIOR ART
FIG. 6 is a sectional view showing the contact legs not positively deformed and attached to the periphery of the conductor of the single-core electrical wire according to the prior art.
Figure 5:
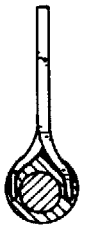
Fig. 5 PRIOR ART
FIG. 5 is a sectional view showing the contact legs of the metal contact plate displaced from the conductor of the single-core electrical wire according to the prior art.
Figure 7:
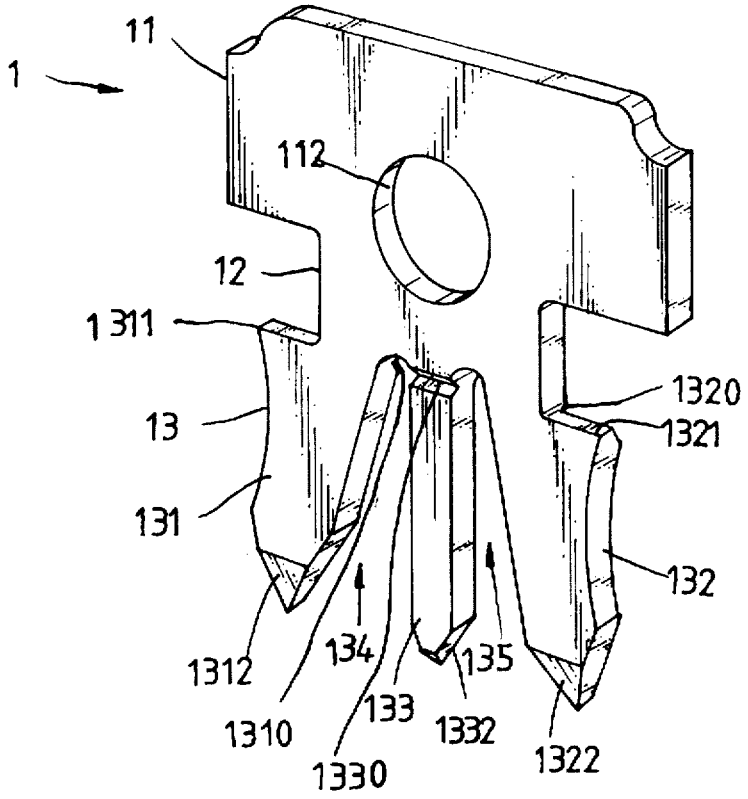
FIG. 7 is an elevational view in an enlarged scale of a metal contact plate according to the present invention.
Figure 8:
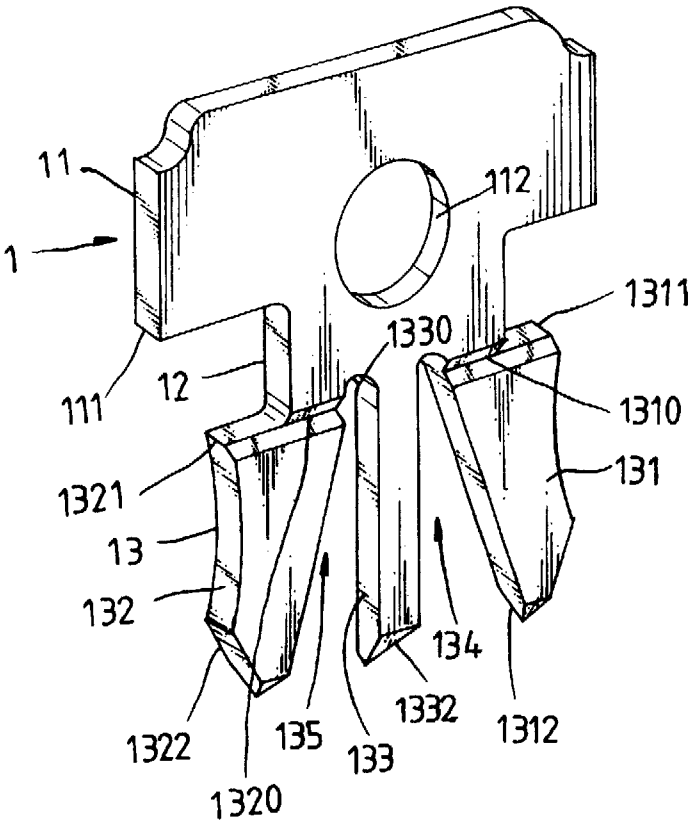
FIG. 8 is another elevational view in an enlarged scale of the metal contact plate of the present invention when viewed from another angle.

Referring to FIGS. 7 and 8 again, transverse grooves 1310, 1320, 1330 are respectively disposed at the connecting area between the neck 12 and the contact legs 131, 132, 133 (see FIGS. 7 and 8). The transverse grooves 1310 and 1320 of the first contact leg 131 and second contact leg 132 are disposed at the back side (same as the bevel bottom edge 1332 of the third contact leg 133). The transverse groove 1330 of the third contact leg 133 is disposed at the front side (same as the bevel bottom edges 1312, 1322 of the first contact leg 131 and second contact leg 132). A first gap 134 is defined between the first contact leg 131 and the third contact leg 133. A second gap 135 is defined between the second contact leg 132 and the third contact leg 133. The gaps 134, 135 have a respective width made gradually wider from the neck 12 toward the bottom side of the metal contact plate 1.

Figure 10:
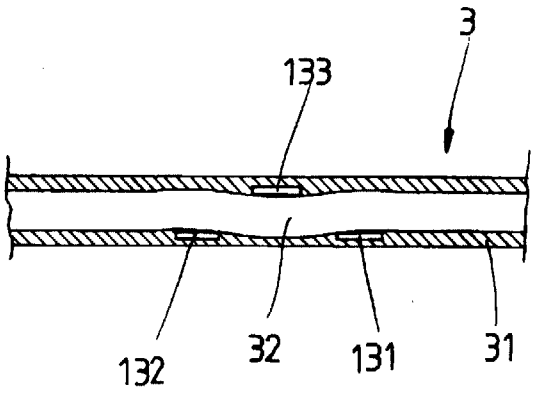
FIG. 10 is a bottom view in section showing the contact legs clamped on the conductor of the single-core electrical wire according to the present invention.
Figure 11:
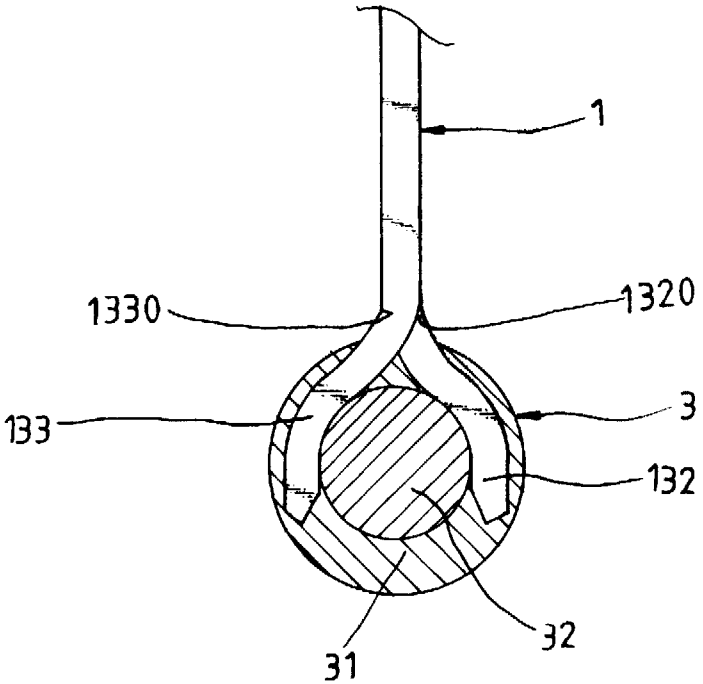
FIG. 11 is a side view in section of the present invention, showing the contact legs cut in the insulator of the single-core electrical wire and clamped on the conductor.

Referring to FIGS. 9, 10 and 11 again, when the contact section 13 of the metal contact plate 1 is forced against the electrical wire 3 by stamping, the bevel bottom edges 1312, 1322 of the first contact leg 131 and second contact leg 132 and the bevel bottom edge 1332 of the third contact leg 133 are forced to cut into the insulator 31 of the electrical wire 3 from two opposite sides and to contact the conductor 32 of the electrical wire 3 at three contact points (see FIG. 10), thereby causing the contact legs 131, 132, 133 to grip the electrical wire 3 firmly (see FIG. 11). Because of the design of the transverse grooves 1310, 1320, 1330, the first contact leg 131 and second contact leg 132 and the third contact leg 133 can be expanded outwards and closely attached to the periphery of the electrical wire 3, and an upward reaction force can be eliminated when the metal contact plate 1 is stamped against the electrical wire 3. Furthermore, because the first contact leg 131 and the second contact leg 132 are respectively spaced from the third contact leg 133 by a respective gap 134, 135 which has a width made gradually wider from the neck 12, the first contact leg 131 and second contact leg 132 and third contact leg 133 will be expanded outwards when the contact section 13 of the metal contact plate 1 is forced to cut in the insulator 31 of the electrical wire 3 and to press against the conductor 32. Therefore, the metal contact plate 1 can be positively forced into close contact with the conductor 32 of the electrical wire 3 without being affected by the type (single core or multi-core) of the conductor 32.

I claim:

1. A metal contact plate adapted for mounting in a channel in a module plug housing and connecting to an electrical wire in the channel, comprising a positioning section for positioning in the channel, a contact section for connecting to the electrical wire, and a neck connected between said positioning section and said contact section, said contact section comprising a first contact leg and a second contact leg bilaterally and downwardly extending from said neck, and a third contact leg downwardly extending from said neck and spaced between said first contact leg and said second contact leg by a respective gap, said first contact leg and said second contact leg having a respective bevel bottom edge disposed at a front side of the metal contact plate and adapted for cutting in the insulator of the electrical wire to make contact with a conductor thereof, said third contact leg having a bevel bottom edge disposed at a back side of the metal contact plate and adapted for cutting in the insulator of the electrical wire to make contact with the conductor of the electrical wire, wherein:

said first contact leg and said second contact leg have a respective transverse groove respectively disposed at the back side of the metal contact plate adjacent to said neck; said third contact leg has a transverse groove disposed at the front side of the metal contact plate adjacent to said neck; said gap has a width made gradually wider from said neck towards a bottom side of the metal contact plate.

* * * * *